US008691076B2

(12) United States Patent
Kim et al.

(10) Patent No.: US 8,691,076 B2
(45) Date of Patent: Apr. 8, 2014

(54) PROCESS FOR MANUFACTURING NAPHTHENIC BASE OILS FROM EFFLUENCES OF FLUIDIZED CATALYTIC CRACKING UNIT

(75) Inventors: Chang Kuk Kim, Daejeon (KR); Jee Sun Shin, Seoul (KR); Ju Hyun Lee, Gyeonggi-do (KR); Sam Ryong Park, Daejeon (KR); Gyung Rok Kim, Daejeon (KR); Yoon Mang Hwang, Daejeon (KR)

(73) Assignee: SK Lubricants Co., Ltd. (KR)

( * ) Notice: Subject to any disclaimer, the term of this patent is extended or adjusted under 35 U.S.C. 154(b) by 815 days.

(21) Appl. No.: 12/667,305

(22) PCT Filed: Nov. 21, 2007

(86) PCT No.: PCT/KR2007/005863

§ 371 (c)(1),
(2), (4) Date: Dec. 30, 2009

(87) PCT Pub. No.: WO2009/011479

PCT Pub. Date: Jan. 22, 2009

(65) Prior Publication Data

US 2011/0005972 A1 Jan. 13, 2011

(30) Foreign Application Priority Data

Jul. 13, 2007 (KR) ..... 10-2007-0070589

(51) Int. Cl.
*C10G 65/08* (2006.01)
*C10G 45/44* (2006.01)

(52) U.S. Cl.
USPC ..... 208/57; 208/60; 208/68; 208/70; 208/100; 208/141

(58) Field of Classification Search
USPC ..... 208/67–69, 70, 97, 100, 134, 137, 138, 208/141, 211, 212, 216 R, 217, 57, 60
See application file for complete search history.

(56) References Cited

U.S. PATENT DOCUMENTS

| | | | | |
|---|---|---|---|---|
| 4,003,822 | A * | 1/1977 | Jo | 208/102 |
| 5,076,910 | A * | 12/1991 | Rush | 208/348 |
| 5,358,627 | A * | 10/1994 | Mears et al. | 208/59 |
| 2004/0222129 | A1 * | 11/2004 | Aldous et al. | 208/49 |
| 2005/0279670 | A1 | 12/2005 | Long et al. | |

FOREIGN PATENT DOCUMENTS

| | | | | |
|---|---|---|---|---|
| EP | 0753037 | | 8/2000 | |
| EP | 01268708 | | 10/2005 | |
| WO | WO 2004/094565 | A1 | 11/2004 | |
| WO | WO 2005/085394 | * | 9/2005 | C10G 65/12 |

OTHER PUBLICATIONS

Fluid Catalytic Cracker Heavy Cycle Oil, http://www.etc-cte.ec.gc.ca/databases/Oilproperties/pdf/WEB Fluid Catalytic_Cracker Heavy-Cycle Oil.pdf. (no date). Accessed Nov. 1, 2012.*

(Continued)

*Primary Examiner* — Renee E Robinson
(74) *Attorney, Agent, or Firm* — DLA Pieper LLP (US)

(57) ABSTRACT

Disclosed is a method of manufacturing high-quality naphthenic base oil by subjecting, as a feedstock, light cycle oil (LCO) and slurry oil (SLO) obtained through fluidized catalytic cracking (FCC) to hydrotreating and dewaxing.

10 Claims, 1 Drawing Sheet

(56) References Cited

OTHER PUBLICATIONS

Light Cycle Oil (LCO), Material Safety Data Sheet. Nov. 2006.*

Fluid Catalytic Cracker Heavy Cycle Oil, http://www.etc-cte.ec.gc.ca/databases/Oilproperties/pdf/WEB_Fluid_Catalytic_Cracker_Heavy_Cycle_Oil.pdf, (no date). Accessed Nov. 1, 2012.*

* cited by examiner

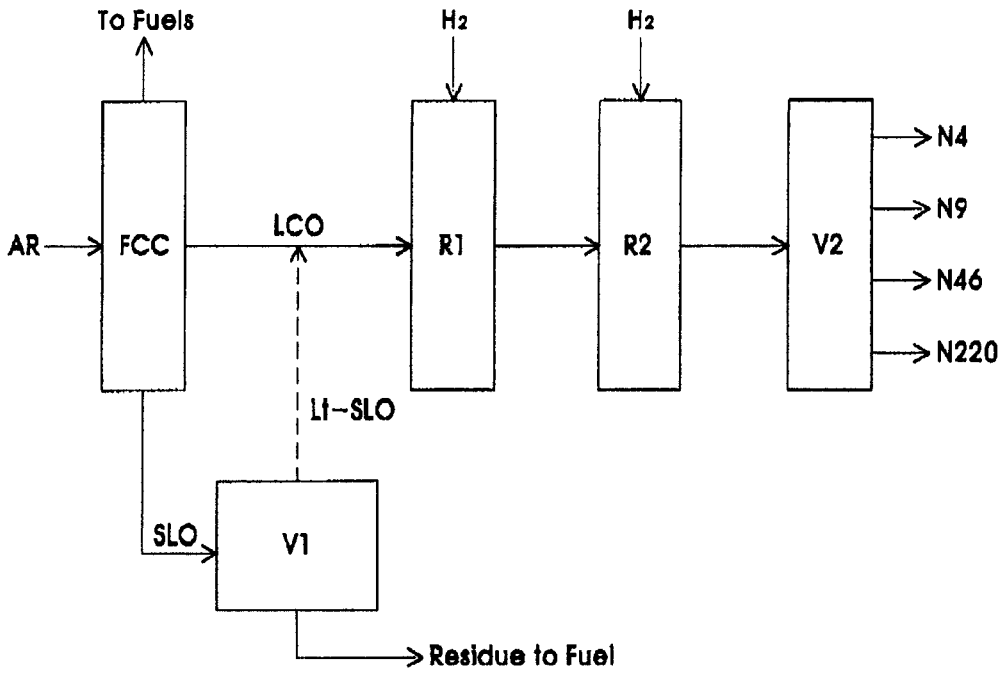
To Fuels
H2
H2
AR
FCC
LCO
R1
R2
V2
N4
N9
N46
N220
Lt-SLO
SLO
V1
Residue to Fuel

PROCESS FOR MANUFACTURING NAPHTHENIC BASE OILS FROM EFFLUENCES OF FLUIDIZED CATALYTIC CRACKING UNIT

RELATED APPLICATION

This is a §371 of International Application No. PCT/KR2007/005863, with an international filing date of Nov. 21, 2007 (WO 2009/011479 A1, published Jan. 22, 2009), which is based on Korean Patent Application No. 10-2007-0070589 filed Jul. 13, 2007.

TECHNICAL FIELD

The present disclosure relates to a method of manufacturing naphthenic base oil from hydrocarbon oil fractions having high aromatic content and large amounts of impurities, and more particularly, to a method of manufacturing high-quality naphthenic base oil by subjecting, as a feedstock, light cycle oil (LCO) or slurry oil (SLO) obtained through fluidized catalytic cracking (FCC) to hydrotreating and dewaxing.

BACKGROUND

Naphthenic base oil is base oil that has a viscosity index of 85 or less and in which at least 30% of the carbon bonds of the base oil are of a naphthenic type, according to ASTM D-2140.

Recently, naphthenic base oil is widely used in various industrial fields, including transformer oil, insulation oil, refrigerator oil, oil for processing rubber and plastic, fundamental material of print ink or grease, and base oil of metal processing oil.

Most conventional methods of manufacturing naphthenic base oil are conducted in such a manner that naphthenic crude oil having a high naphthene content (naphthene content: 30~40%), serving as a feedstock, is passed through a vacuum distillation unit to thus separate a paraffinic component and then through extraction and/or hydrogenation units to thus separate an aromatic component and/or convert it into naphthene, after which impurities are removed.

However, these methods are problematic in that the essential use of the naphthenic crude oil, having a high naphthene content, as the feedstock encounters a limitation in the supply thereof, and furthermore, the extraction procedure for extracting the aromatic component must be conducted, undesirably decreasing the total product yield and deteriorating the quality of the product.

International Patent No. WO 2004/094565 discloses a method of manufacturing naphthenic base oil by subjecting mixed effluents of various processes, serving as a feedstock, to hydrofining to thus obtain an oil fraction, which is then stripped to separate only an oil fraction having a boiling point within a predetermined range, and then dewaxing the separated oil fraction. However, the above method is disadvantageous because, among the effluents of the hydrofining process, only a middle oil fraction, excluding a light oil fraction and a heavy bottom oil fraction, is used to produce the naphthenic base oil, undesirably decreasing the total product yield. Further, because the effect of the hydrofining process for removing impurities is not high, sulfur is contained in a large amount in the middle oil fraction, separated through stripping, undesirably remarkably reducing the activity and selectivity of a catalyst used for a subsequent dewaxing process.

SUMMARY

Accordingly, the present disclosure provides a method of manufacturing naphthenic base oil, which includes hydrotreating and dewaxing an inexpensive hydrocarbon feedstock having a high aromatic content and large amounts of impurities, in particular, an effluent of an FCC process, for example, LCO or SLO, under extreme conditions, thereby producing expensive naphthenic base oil at high yield while minimizing the loss and removal of the oil fraction.

According to the present disclosure, a method of manufacturing a naphthenic base oil from an oil fraction of fluidized catalytic cracking may include (a) separating a light cycle oil and a slurry oil from an oil fraction obtained through fluidized catalytic cracking of petroleum hydrocarbon; (b) hydrotreating the light cycle oil, the slurry oil, or a mixture thereof, separated in the (a), under conditions of temperature of 280~430° C., pressure of 30~200 kg/cm$^2$, liquid hourly space velocity (LHSV) of 0.2~3 hr$^{-1}$ and a volume ratio of hydrogen to the fed oil fraction of 800~2500 Nm$^3$/m$^3$ in the presence of a hydrotreating catalyst; (c) dewaxing the hydrotreated oil fraction obtained in the (b), under conditions of temperature of 280~430° C., pressure of 30~200 kg/cm$^2$, liquid hourly space velocity (LHSV) of 0.2~3 hr$^{-1}$ and a volume ratio of hydrogen to the fed oil fraction of 300~1500 Nm$^3$/m$^3$ in the presence of a dewaxing catalyst; and (d) separating the dewaxed oil fraction obtained in the (c) according to a range of viscosity, all of which are conducted sequentially.

In the present disclosure, LCO and/or SLO, obtained through an FCC process, which are inexpensive products having high aromatic content and large amounts of impurities, are used to produce high-quality naphthenic base oil, thereby considerably mitigating the limitation of a feedstock to thus improve economic efficiency and facilitating the manufacture of products having excellent performance at high yield.

According to the present disclosure, hydrotreating is conducted under extreme conditions, thus remarkably diminishing the level of impurities, by which isomerization actively occurs in a subsequent dewaxing process, thereby enabling the production of high-quality products at high yield.

BRIEF DESCRIPTION OF THE DRAWINGS

FIG. 1 is a schematic view illustrating a process of manufacturing naphthenic base oil, according to an example of the present disclosure.

DETAILED DESCRIPTION

A process of manufacturing naphthenic base oil according to one exemplary embodiment is illustrated in FIG. 1. The following reference terms are shown in FIG. 1:

FCC: fluidized catalytic cracking

R1: hydrotreating

R2: dewaxing

V1, V2: vacuum distillation

Hereinafter, a detailed description will be given of the example shown in FIG. 1.

According to the present disclosure, as illustrated in FIG. 1, the manufacturing process includes subjecting light cycle oil (LCO) and slurry oil (SLO), obtained through fluidized catalytic cracking (FCC) of petroleum hydrocarbons, to hydrotreating R1, subjecting the hydrotreated oil fraction to dewaxing R2, and separating the dewaxed oil fraction according to the range of viscosity using a separation unit V2.

The method of manufacturing the naphthenic base oil according to the present disclosure is characterized in that the naphthenic base oil is produced from the LCO or SLO having a high aromatic content and large amounts of impurities, which is separated from an effluent of FCC of petroleum hydrocarbons.

The LCO or SLO used in the present disclosure is obtained through the FCC process. The FCC (Fluidized Catalytic Cracking) process is a technique for producing a light petroleum product by subjecting an atmospheric residue feedstock to FCC under temperature/pressure conditions of 500~700° C. and 1~3 atm. Such an FCC process enables the production of a volatile oil fraction, as a main product, and propylene, heavy cracked naphtha (HCN), LCO, and SLO, as by-products. Among the products thus obtained, the LCO or SLO, but not the light oil fraction, is separated using a separation tower. Because this oil has a high concentration of impurities and large amounts of heteroatom species and aromatic material, it is difficult to use as a light oil fraction, which is a highly valued product, and is mainly used for high-sulfur light oil products or inexpensive heavy fuel oils.

In the method according to the present disclosure, as illustrated in FIG. 1, atmospheric residue (AR) is introduced to the FCC process, to thus obtain the LCO or SLO, which is then used as a feedstock to manufacture high-quality naphthenic lube base oil.

As the feedstock of the method according to the present disclosure, the LCO and the SLO may be used alone, or may also be used mixed at a predetermined ratio.

As shown in FIG. 1, the SLO used in the present disclosure may be subjected to vacuum distillation V1 before being subjected to hydrotreating R1. Then, light slurry oil (Lt-SLO) having a boiling point of 360~480° C., separated through vacuum distillation V1, may be subjected alone to hydrotreating R1, or alternatively, may be supplied in the form of a mixture with LCO.

Useful as the feedstock in the present disclosure, the LCO, the SLO, the Lt-SLO separated through vacuum distillation, and mixture oil of LCO and part or all of SLO or Lt-SLO, mixed at equivalent volume ratios, are summarized in terms of their properties in Table 1 below.

TABLE 1

| | | LCO (A) | SLO (B) | Lt-SLO (C) | (A) + (B) | (A) + (C) |
|---|---|---|---|---|---|---|
| Specific Gravity | 15° C. | 1.0047 | 1.0582 | 1.034 | 1.0368 | 1.0315 |
| Pour Point | ° C. | 10.00 | 2.5 | | 5 | 0 |
| Kinetic Viscosity, cSt | 40° C. | 14.78 | | 76.72 | 112.3 | 21.67 |
| | 100° C. | 2.76 | | 5.701 | 6.95 | 3.202 |
| | VI | −46 | | −138 | −123 | −117 |
| Sulfur | wt. ppm | 7355 | 7211 | 6969 | 7565 | 7414 |
| Nitrogen | wt. ppm | 2255 | 2895 | 2800 | 2515 | 2450 |
| HPLC (Aromatic Analysis) | MAH % | 5.4 | 5.2 | 4.9 | 5.25 | 5.0 |
| | DAH % | 13.7 | 8.2 | 6.5 | 10.8 | 10.2 |
| | PAH % | 55.8 | 72.4 | 66.7 | 64.4 | 60.7 |
| | TAH % | 74.8 | 85.8 | 78.1 | 80.45 | 75.9 |

Note:
MAH: mono-aromatic hydrocarbon
DAH: di-aromatic hydrocarbon
PAH: poly-aromatic hydrocarbon
TAH: total aromatic hydrocarbon As is apparent from Table 1, the LCO and the SLO used for the production of naphthenic base oil according to the present disclosure, having a sulfur content of 5000 ppm or more, a nitrogen content of 1000 ppm or more, and a total aromatic content of 60 wt % or more, can be seen to have impurity content and aromatic content much higher than general naphthenic crude oil, which contains about 0.1~0.15 wt % sulfur, about 500~1000 ppm nitrogen, and 10~20 wt % aromatics.

Because the LCO or SLO, serving as the feedstock, contains large amounts of aromatics and impurities, sulfur, nitrogen, oxygen, and metal components contained in the feedstock are removed through hydrotreating R1, and the contained aromatic component is converted into a naphthenic component through hydrogen saturation.

In the method of manufacturing the naphthenic base oil according to the present disclosure, the hydrotreating R1 is conducted under conditions of temperature of 280~430° C., pressure of 30~200 kg/cm$^2$, LHSV (Liquid Hourly Space Velocity) of 0.2~3 hr$^{-1}$ and a volume ratio of hydrogen to feedstock of 800~2500 Nm$^3$/m$^3$. By supplying a large amount of hydrogen and applying extreme conditions of temperature and pressure, the amounts of aromatics and impurities contained in the feedstock may be drastically decreased. In the present disclosure, in particular, the volume ratio of hydrogen to feedstock plays an important role. In the hydrotreating process according to the present disclosure, the partial pressure of hydrogen is maintained very high, which is essential for maintaining the performance of the hydrotreating catalyst in terms of the following two points. First, the concentration of hydrogen is increased, thereby increasing the activity of the catalyst to thus raise the hydrotreating rate. Second, the production of a derivative forming coke on the surface of the activated catalyst is inhibited, thereby decreasing the formation of the coke. This helps decrease the rate of fouling of the catalyst. In the present process, in order to prevent the decrease of the activity of the catalyst and maximize the reactivity and the yield, the preferable volume ratio of hydrogen ($H_2$/oil) is set to 1000~2000 Nm$^3$/m$^3$.

The hydrotreating catalyst used in the hydrotreating process is preferably composed of metals of Groups 6 and 8 to 10 in the periodic table, and more preferably contains one or more selected from among CoMo, NiMo, and a combination of CoMo and NiMo. However, the hydrotreating catalyst used in the present disclosure is not limited thereto, and any hydrotreating catalyst may be used so long as it is effective for hydrogen saturation and the removal of impurities.

The hydrotreated oil fraction has impurities and aromatics in drastically decreased amounts. In the method according to the present disclosure, the hydrotreated oil fraction has a sulfur content of less than 300 ppm, a nitrogen content of less than 50 ppm, and an aromatic content of less than 80 wt %. In particular, the amount of poly-aromatic hydrocarbon is decreased so that it is not more than 10%.

In the method according to the present disclosure, the oil fraction, subjected to hydrotreating R1, has impurities at very low levels and low poly-aromatic hydrocarbon content, thereby maximally preventing a precious metal-based dewaxing catalyst for a subsequent dewaxing process from being inactivated by impurity poisoning.

In the case where the hydrotreating process is performed under optimal conditions mentioned above, the hydrotreated oil fraction, from which only the gaseous component is removed, is wholly subjected to dewaxing R2, without the need to additionally separate or remove a light oil fraction or a bottom oil fraction therefrom.

The catalytic dewaxing process R2 according to the present disclosure is largely divided into dewaxing, including selective cracking or isomerization of a paraffinic oil fraction, and hydrofinishing. In the course of dewaxing using isomerization, isomerization occurs more actively because the amount of impurities, such as sulfur and nitrogen, is drastically decreased through upstream deep hydrotreating. Thereby, high-quality naphthenic base oil, in which a naphthenic component is enriched and from which considerable amounts of impurities are removed, is produced at high yield.

More specifically, the dewaxing process R2 is conducted under conditions of temperature of 280~430° C., pressure of 30~200 kg/cm$^2$, LHSV of 0.2~3 hr$^{-1}$, and a volume ratio of hydrogen to feedstock of 300~4500 Nm$^3$/m$^3$.

The dewaxing catalyst used for the dewaxing process R2 preferably contains one or more selected from among precious metals of Group 9 or 10 in the periodic table, and more preferably one or more selected from among Pt, Pd and a combination of Pt and Pd. However, the dewaxing catalyst used in the present disclosure is not limited thereto, and any dewaxing catalyst may be used without limitation as long as it is effective for dewaxing through selective cracking or isomerization.

In the method of manufacturing the naphthenic base oil according to the present disclosure, the oil fraction, subjected to dewaxing R2, contains sulfur in an amount of 100 ppm or less and naphthene in an amount of 35 wt % or more.

Although the oil fraction subjected to dewaxing R2 may be used as naphthenic base oil without change, in the present disclosure, in consideration of various end uses of the naphthenic base oil, it may be separated into a plurality of base oils having viscosity ranges suitable for respective end uses. To this end, separation V2 of the dewaxed oil fraction is conducted. For example, the separation V2 enables the dewaxed oil fraction to be separated into naphthenic base oils having kinetic viscosities at 40° C. of 3~5 cSt, 8~10 cSt, 43~57 cSt, 90~120 cSt, and at least 200 cSt.

The process for separating the dewaxed oil fraction may be performed using a known separation unit that is suitable for the above separation conditions. Examples of such a separation unit include an atmospheric distillation tower or a vacuum distillation tower. Particularly useful is the vacuum distillation tower.

A better understanding of the present disclosure may be obtained through the following examples, which are set forth to illustrate, but are not to be construed as the limit of the present invention.

EXAMPLE 1

Production of Naphthenic Base Oil from Light Cycle Oil

A light cycle oil (LCO) fraction having a boiling point of 310~380° C. was separated through FCC and was then supplied to a hydrotreating reactor.

The hydrotreating was conducted using a combination catalyst of cobalt-molybdenum and nickel-molybdenum as a hydrotreating catalyst, under conditions of LHSV of 0.5~2.0 hr$^{-}$, a volume ratio of hydrogen to feedstock of 1000~2000 Nm$^3$/m$^3$, pressure of 120~160 kg/cm$^2$, and temperature of 300~400° C.

After the hydrotreating process, the resultant middle oil fraction had a sulfur content of less than 100 ppm, a nitrogen content of less than 20 ppm, and an aromatic content of less than 70 wt %, and preferably a sulfur content of less than 40 ppm, a nitrogen content of less than 10 ppm, and an aromatic content of less than 66 wt %.

For a subsequent dewaxing process, an isomerization dewaxing catalyst and a hydrofinishing catalyst, composed of (Pt/Pd)/zeolite/alumina, which is commercially available, were used, and the dewaxing was conducted under conditions of LHSV of 0.5~2.0 hr$^{-1}$, a volume ratio of hydrogen to feedstock of 400~1000 Nm$^3$/m$^3$, and pressure of 120~160 kg/cm$^2$. For this, the reaction temperature was set to 300~350° C. for isomerization dewaxing and 210~300° C. for hydrofinishing.

Table 2 below shows the properties of the feedstock (LCO) of the present example and of the naphthenic base oil (product) obtained therefrom using hydrotreating and dewaxing. As is apparent from Table 2, through the method according to the present disclosure, high-quality naphthenic base oil, having a naphthene content of about 63.5%, kinetic viscosity of about 8.89 cSt at 40° C., and sulfur and nitrogen content and aromatic content much lower than those of the feedstock, and in which a naphthene component was enriched, was produced.

TABLE 2

| | | LCO | Product |
|---|---|---|---|
| Pour Point | ° C. | 10 | −44 |
| Kinetic Viscosity, cSt | 40° C. | 14.78 | 8.89 |
| | 100° C. | 2.76 | 2.32 |
| Sulfur | wt. ppm | 7355 | 4 |
| Nitrogen | wt. ppm | 2255 | 1 |
| Naphthene in Hydrocarbon | % | — | 63.5 |
| HPLC (Aromatic Analysis) | MAH % | 5.40 | 1.49 |
| | DAH % | 13.67 | 0.00 |
| | PAH % | 55.76 | 0.00 |
| | TAH % | 74.83 | 1.49 |

EXAMPLE 2

Production of Naphthenic Base Oil from Light Slurry Oil

Slurry oil (SLO) having a boiling point of 345° C. or higher, obtained through FCC, was separated into a light oil fraction, a middle oil fraction, and a bottom oil fraction using a vacuum distillation unit (VDU). The light oil fraction or the middle oil fraction, but not the bottom oil fraction, was supplied to a hydrotreating reactor. In the present example, naphthenic base oil was manufactured using, as a feedstock, the light oil fraction having a boiling point of 360~480° C.

The hydrotreating was conducted using a combination catalyst of nickel-molybdenum, available from Nippon Ketjen, under conditions of LHSV of 0.5~2.0 hr$^{-1}$, a volume ratio of hydrogen to feedstock of 1500~2000 Nm$^3$/m$^3$, pressure of 140~200 kg/cm$^2$, and temperature of 330~400° C.

After the hydrotreating process, the resultant middle oil fraction had a sulfur content of less than 110 ppm and polyaromatic hydrocarbon in an amount of 10 wt % or less.

Subsequently, dewaxing was conducted using an isomerization dewaxing catalyst and a hydrofinishing catalyst, composed of (Pt/Pd)/zeolite/alumina, which is commercially available, under conditions of LHSV of 0.5~2.0 $hr^{-1}$, a volume ratio of hydrogen to feedstock of 400~1000 $Nm^3/m^3$, and reaction pressure of 140~160 $kg/cm^2$. For this, the reaction temperature was set to 300~370° C. for isomerization dewaxing and 210~300° C. for hydrofinishing.

Table 3 below shows the properties of the light slurry oil (Lt-SLO) used as the feedstock and the product (after CDW). The sulfur content and the nitrogen content in the product were drastically decreased compared to those in the feedstock, and, in the product, the naphthene content was about 56%, and kinetic viscosity at 40° C. was about 45.5 cSt.

TABLE 3

| | | Lt-SLO | Product |
|---|---|---|---|
| Pour Point | ° C. | 10 | −33 |
| Kinetic Viscosity | 40° C. | 76.72 | 45.5 |
| | 100° C. | 5.701 | — |
| Sulfur | wt. ppm | 6969 | 10 |
| Nitrogen | wt. ppm | 2000 | 1 |
| Naphthene in Hydrocarbon | % | — | 56 |
| HPLC (Aromatic Analysis) | MAH % | 4.85 | 2.0 |
| | DAH % | 6.52 | 0.5 |
| | PAH % | 66.69 | 1.0 |
| | TAH % | 78.06 | 3.5 |

EXAMPLE 3

Production of Naphthenic Base Oil from Mixture of Light Cycle Oil and Light Slurry Oil The LCO, separated through the FCC in Example 1, and the Lt-SLO, separated using the VDU in Example 2, were mixed at the same volume ratio and used as a feedstock in that state.

Hydrotreating was conducted using a combination catalyst of nickel-molybdenum, available from Nippon Ketjen, under conditions of LHSV of 0.5~2.0 $hr^{-1}$, a volume ratio of hydrogen to feedstock of 1300~2000 $Nm^3/m^3$, pressure of 130~190 $kg/cm^2$, and temperature of 340~400° C.

After the hydrotreating process, the resultant middle oil fraction had a sulfur content of less than 40 ppm.

Subsequently, dewaxing was conducted using an isomerization dewaxing catalyst and a hydrofinishing catalyst, composed of (Pt/Pd)/zeolite/alumina, which is commercially available, under conditions of LHSV of 0.5~2.0 $hr^{-1}$, a volume ratio of hydrogen to feedstock of 400~1000 $Nm^3/m^3$, and reaction pressure of 130~160 $kg/cm^2$. For this, the reaction temperature was set to 300~370° C. for isomerization dewaxing and 210~300° C. for hydrofinishing.

Table 4 below shows the properties of the feedstock and the product (after CDW). In the present example, the final oil fraction could be used as naphthenic base oil without change, but was separated into four naphthenic base oils having kinetic viscosities at 40° C. of 3~5 cSt, 8~10 cSt, 43~57 cSt, and at least 200 cSt, in order to be adapted to various end uses of the naphthenic base oil. The sulfur content and the nitrogen content in the product were drastically decreased compared to those in the feedstock, and high-quality naphthenic base oil products having naphthene in an amount of about 55% or higher were manufactured.

TABLE 4

| | | LCO + Lt-SLO | N4 | N9 | N46 | N220 |
|---|---|---|---|---|---|---|
| Pour Point | ° C. | 0 | | | | |
| Kinetic | 40° C. | 21.67 | 3.891 | 9.653 | 45.67 | 225.5 |
| Viscosity | 100° C. | 3.202 | 1.404 | 2.361 | 5.176 | 12.18 |
| Sulfur | wt. ppm | 7414 | | | <20 | |
| Nitrogen | wt. ppm | 2450 | | | <10 | |
| Naphthene in Hydrocarbon | % | — | — | 74 | 62.5 | 55 |
| HPLC | MAH % | 5.0 | 1.62 | 4.54 | 10.47 | 8.66 |
| (Aromatic | DAH % | 10.2 | 0.38 | 0.73 | 2.30 | 2.50 |
| Analysis) | PAH % | 60.7 | 0.01 | 0.06 | 0.24 | 1.79 |
| | TAH % | 75.9 | 2.01 | 5.33 | 13.01 | 12.95 |

EXAMPLE 4

Production of Naphthenic Base Oil from Slurry Oil

Naphthenic base oil was manufactured using SLO having a boiling point of 345° C. or higher, obtained through FCC, as a feedstock.

Hydrotreating was conducted using a combination catalyst of nickel-molybdenum, available from Nippon Ketjen, under conditions of LHSV of 0.5~2.0 $hr^{-1}$, a volume ratio of hydrogen to feedstock of 1500~2000 $Nm^3/m^3$, pressure of 150~200 $kg/cm^2$, and temperature of 350~400° C.

After the hydrotreating process, the resultant middle oil fraction had a sulfur content of less than 110 ppm and polyaromatic hydrocarbon in an amount of 10 wt % or less.

Subsequently, dewaxing was conducted using an isomerization dewaxing catalyst and a hydrofinishing catalyst, composed of (Pt/Pd)/zeolite/alumina, which is commercially available, under conditions of LHSV of 0.5~2.0 $hr^{-1}$, a volume ratio of hydrogen to feedstock of 400~1000 $Nm^3/m^3$, and reaction pressure of 140~160 $kg/cm^2$. For this, the reaction temperature was set to 320~370° C. for isomerization dewaxing and 210~300° C. for hydrofinishing.

Table 5 below shows the properties of the slurry oil (SLO) as the feedstock and the naphthenic base oil as the product (after CDW). In the present example, the sulfur content and the nitrogen content in the product were drastically decreased compared to those in the feedstock, and, in the product, the naphthene content was about 52% and the kinetic viscosity at 40° C. was about 110 cSt.

TABLE 5

| | | SLO | Product |
|---|---|---|---|
| Pour Point | ° C. | 2.5 | −27 |
| Kinetic Viscosity | 40° C. | — | 110 |
| | 100° C. | | 8.38 |
| Sulfur | wt. ppm | 7211 | <30 |
| Nitrogen | wt. ppm | 2895 | <10 |
| Naphthene in Hydrocarbon | % | — | 52 |
| HPLC (Aromatic Analysis) | MAH % | 5.2 | 2.65 |
| | DAH % | 8.2 | 0.8 |
| | PAH % | 72.4 | 1.2 |
| | TAH % | 85.8 | 4.65 |

The foregoing examples are provided merely for the purpose of explanation and are in no way to be construed as limiting. While reference to various embodiments are shown, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The invention claimed is:

1. A method of manufacturing naphthenic base oil from an oil fraction of fluidized catalytic cracking, comprising:

(a) separating a light cycle oil and a slurry oil from an oil fraction obtained through fluidized catalytic cracking of petroleum hydrocarbon;

(b) hydrotreating the light cycle oil, the slurry oil or a mixture thereof, separated in step (a), under conditions of temperature of 280-430° C. pressure of 120-200 $kg/cm^2$, liquid hourly space velocity (LHSV) of 0.2-3 $hr^{-1}$ and a volume ratio of hydrogen to the fed oil fraction of 1500-2500 $Nm^3/n^3$ in presence of a hydrotreating catalyst;

(c) dewaxing a whole hydrotreated oil fraction; obtained wholly from step (b), from which only the gaseous components are removed, under conditions of temperature of 280-430° C., pressure of 30-200 $kg/cm^2$, liquid hourly space velocity (LHSV) of 0.2-3 $hr^{-1}$ and a volume ratio of hydrogen to the fed oil fraction of 300-1500 $Nm^3/m^3$ in presence of a dewacing catalyst; and (d) separating a dewaxed oil fraction obtained in step (c), according to a range of viscosity, wherein all of steps (a) through (d) are conducted sequentially and successively, wherein said light cycle oil, the slurry oil or a mixture thereof has a total aromatic content of 60 wt % or more, and a poly-aromatic content of 55.8 wt % to 72.4 wt %, wherein, the oil fraction hydrotreated in step (a) has a poly-aromatic content of not more than 10 wt %, wherein the naphthenic base oil has a viscosity index of 85 or less, at least 30% of the carbon bonds of the naphthenic base oil being naphthenic type, and wherein the naphthenic base oil has a naphthene content equal to or greater than 35 wt %.

2. The method according to claim 1, wherein the hydrotreating catalyst contains one or more selected from among metals of Groups 6 and 8 to 10 in a periodic table.

3. The method according to claim 1, wherein the dewaxing catalyst contains one or more selected from among precious metals of Group 9 or 10 in a periodic table.

4. The method according to claim 1, wherein each of the light cycle oil and the slurry oil has a sulfur content equal to or greater than 5000 ppm, and a nitrogen content equal to or greater than 1000 ppm.

5. The method according to claim 1, wherein step (d) is conducted using a vacuum distillation tower.

6. The method according to claim 1, wherein step (d) enables the oil fraction to be separated into napthenic base oils having kinetic viscosities at 40° C. of 3-5 cSt, 8-10 cSt, 43-57 cSt, 90-120 cSt, and at least 200 cSt.

7. The method according to claim 1, wherein the naphthenic base oil has a sulfur content less than or equal to 100 ppm.

8. The method according to claim 1, wherein said light cycle oil, the slurry oil or a mixture thereof has a total aromatic content of 74.8-85.8 wt %.

9. A method of manufacturing naphthenic base oil from an oil fraction of fluidized catalytic cracking, comprising:

(a) separating a light cycle oil and a slurry oil from an oil fraction obtained through fluidized catalytic cracking of petroleum hydrocarbon;

(b) separating a light slurry oil having a boiling point of 360-480° C. from the slurry oil obtained from step (a) through vacuum distillation;

(c) hydrotreating the light cycle oil separated in step (a), the light slurry oil separated in step (b) or a mixture thereof under conditions of temperature of 280-430° C., pressure of 120-200 $kg/cm^2$, liquid hourly space velocity (LHSV) of 0.2-3 $hr^{-1}$ and a volume ratio of hydrogen to the fed oil fraction of 1500-2500 $Nm^3/m^3$ in presence of a hydrotreating, catalyst;

(d) dewaxing, a whole hydrotreated oil fraction, obtained wholly from step (c), from which only the gaseous components are removed, under conditions of temperature of 280-430° C., pressure of 30-200 $kg/cm^2$, liquid hourly space velocity (LHSV) of 0.2-3 $hr^{-1}$ and a volume ratio of hydrogen to the fed oil fraction of 300-1500 $Nm^3/m^3$ in presence of a dewaxing catalyst; and (e) separating a dewaxed oil fraction obtained in step (d), according to a range of viscosity, wherein all of steps (a) through (e) are conducted sequentially and successively, wherein said light cycle oil, the light slurry oil or a mixture thereof has a total aromatic content of 60 wt % or more, and a poly-aromatic content of 55.8 wt % to 72.4 wt %, wherein the oil fraction hydrotreated in step (a) has a poly-aromatic content of not more than 10 wt %, wherein the napthenic base oil has a viscosity index of 85 or less, at least 30% of the carbon bonds of the naphthenic base oil being naphthenic type, and wherein the naphthenic base oil has a naphthene content equal to or greater than 35 wt %.

10. The method according to claim 9, wherein said light cycle oil, the slurry oil or a mixture thereof has a total aromatic content of 74.8-85.8 wt %.

* * * * *

UNITED STATES PATENT AND TRADEMARK OFFICE

CERTIFICATE OF CORRECTION

PATENT NO. : 8,691,076 B2
APPLICATION NO. : 12/667305
DATED : April 8, 2014
INVENTOR(S) : Kim et al.

It is certified that error appears in the above-identified patent and that said Letters Patent is hereby corrected as shown below:

In the Claims:

In Column 9

At line 23, please change “dewacing” to --dewaxing--.

Signed and Sealed this
Twenty-fifth Day of November, 2014

Michelle K. Lee

Michelle K. Lee
*Deputy Director of the United States Patent and Trademark Office*